United States Patent [19]

Sorrentino

[11] Patent Number: 4,510,852

[45] Date of Patent: Apr. 16, 1985

[54] WINDOW-TYPE AIR CONDITIONER MOUNTING ASSEMBLY

[76] Inventor: Anthony A. Sorrentino, 21 Henry St., South Farmingdale, N.Y. 11735

[21] Appl. No.: 520,548

[22] Filed: Aug. 5, 1983

[51] Int. Cl.[3] ..... F24F 5/00

[52] U.S. Cl. ..... 98/94.2

[58] Field of Search ..... 62/262; 98/94; 248/208, 248/236; 312/101

[56] References Cited

U.S. PATENT DOCUMENTS

| | | | |
|---|---|---|---|
| 2,436,713 | 2/1948 | Cody | 98/94 AC X |
| 2,519,086 | 8/1950 | Eberhart | 98/94 AC X |
| 2,702,175 | 2/1955 | Hanin | 98/94 AC |
| 2,818,793 | 1/1958 | Hord | 98/94 AC |
| 2,822,745 | 2/1958 | Frank et al. | 98/94 AC |
| 2,871,778 | 2/1959 | Brehm, Jr. et al. | 98/94 AC |
| 3,257,933 | 6/1966 | Baylinson | 98/94 AC |

*Primary Examiner*—Harold Joyce

*Attorney, Agent, or Firm*—Hubbell, Cohen, Stiefel & Gross

[57] ABSTRACT

A window-type air conditioner mounting assembly includes upper and lower elongated rails defining a path along which a supported air conditioner is movable between a first, nonoperative position within the room and remote from the window and a second, operative position in which the air conditioner is disposed in projecting relation through the open window. A flap pivotally supported on the lower rails adjacent the window is engageable with the lowered window sash to create an effective barrier against ambient air leakage when the air conditioner is operatively disposed for use; in the first or storage condition of the air conditioner unit, on the other hand, the window sash is fully and normally closeable in front of the unit to thereby assure an effective seal against air leakage and to protect the air conditioner against the weather elements.

4 Claims, 4 Drawing Figures

FIG. 2
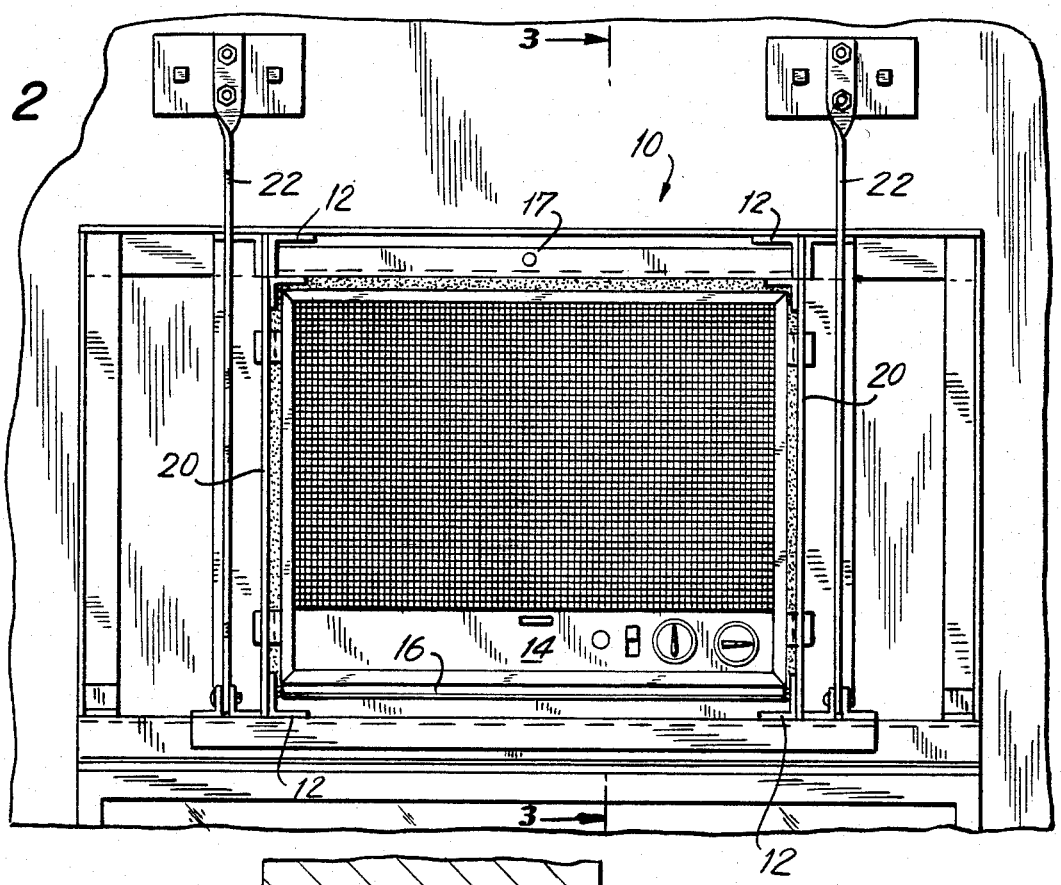
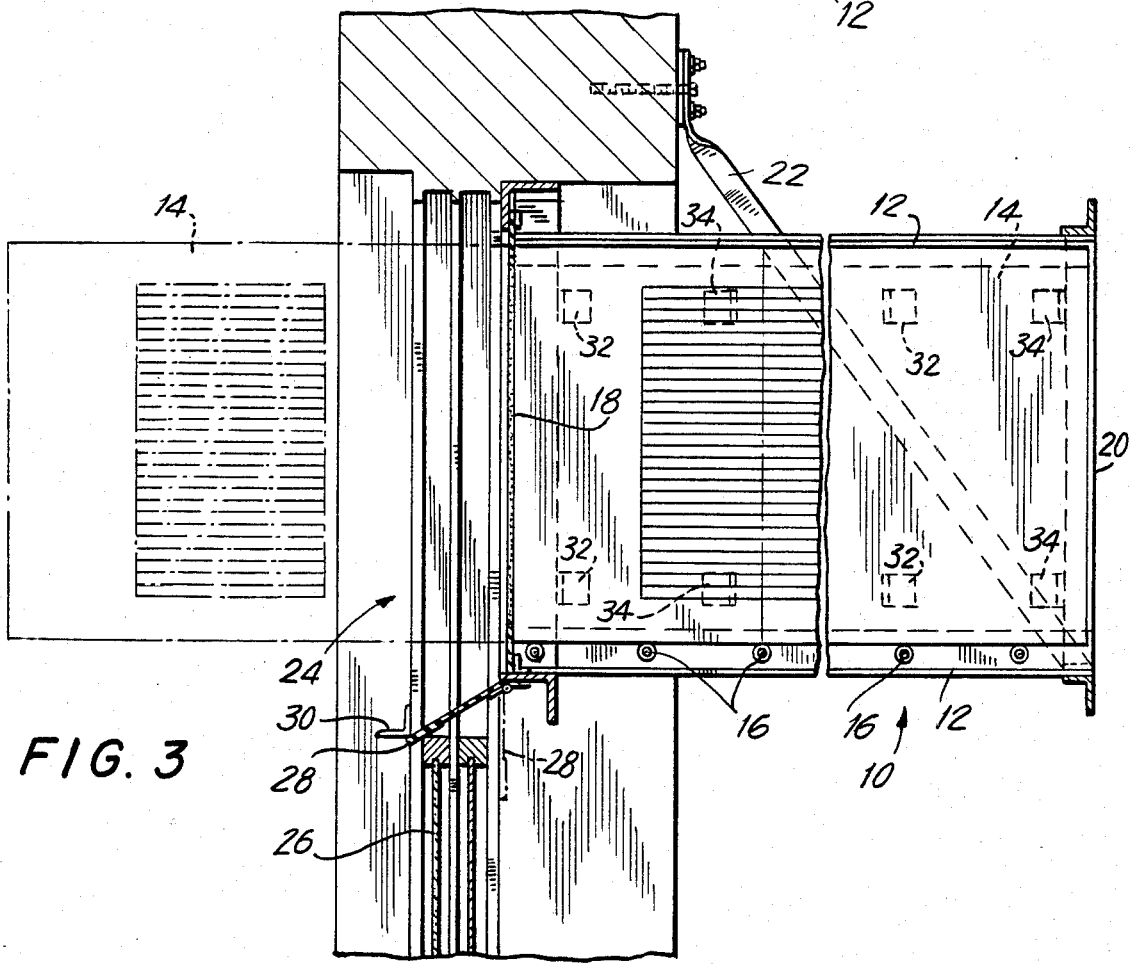
FIG. 3

WINDOW-TYPE AIR CONDITIONER MOUNTING ASSEMBLY

BACKGROUND OF THE INVENTION

The present invention relates generally to air conditioner mounts, and more particularly to a supporting structure for a window-mountable air conditioner unit by which the unit is operatively positioned for use in normal projecting relation through the window and is readily retractable during periods of non-use to an interior storage position remote from the window to enable the window to be fully closed and sealed against ambient air leakage when use of the air conditioner is not required.

Inherent in the use of a window-mounted air conditioner are problems in properly supporting and positioning the unit in projecting relation through a window. Significant difficulty is often encountered in creating an effective seal between the air conditioner unit and the partially open moveable window elements, or between the unit and a mounting bracket or adaptor into which it may be fitted in a particular installation.

The problem of ambient air leakage about an improperly or imperfectly mounted operating air conditioner is of course significant in that it can noteably reduce the unit's efficiency in cooling a room or interior space. Moreover, the difficulty encountered in properly mounting a window air conditioner—and the corresponding problems involved in removing the unit during winter or cooler months and then reinstalling it for each subsequent warm weather season—effectively dictates that such units remain in window-mounted relation year-round. During the winter months, when the outdoor temperature can drop substantially and strong, cold winds become a significant factor, leakage of ambient air about an imperfectly mounted air conditioner causes a decrease in interior space heating efficiency with a corresponding increase in heating fuel requirements. Recent sizable increases in the prices of oil and gas make the avoidance of waste of this sort a particularly desirable goal.

It is therefore the desideratum of the present invention to provide a mounting assembly for a window air conditioner that minimizes ambient air leakage about the unit. It is a particular object to provide an air conditioner supporting structure that enables ambient air leakage to be substantially eliminated during extended periods of non-use of the unit.

It is another object of the present invention to provide an air conditioner mounting assembly that is relatively low in cost, is easy to install and which may be readily and economically manufactured utilizing well-known techniques and available materials.

Further objects, features and advantageous of the present invention will be more fully appreciated by reference to the following detailed description of a presently preferred, but nonetheless illustrative, embodiment in accordance with the present invention when taken in conjunction with the accompanying drawing.

BRIEF DESCRIPTION OF THE DRAWING

In the drawing, wherein similar reference characters denote similar elements throughout the several views:

FIG. 2 is an elevated rear view of the mounting assembly of FIG. 1;

FIG. 3 is a side view of the mounting assembly of FIG. 1 supporting an air conditioner represented in dotted line perspective in both its outwardly projecting operative position and its interiorly remote storage position.

DETAILED DESCRIPTION OF THE PREFERRED EMBODIMENT

Figure 1:
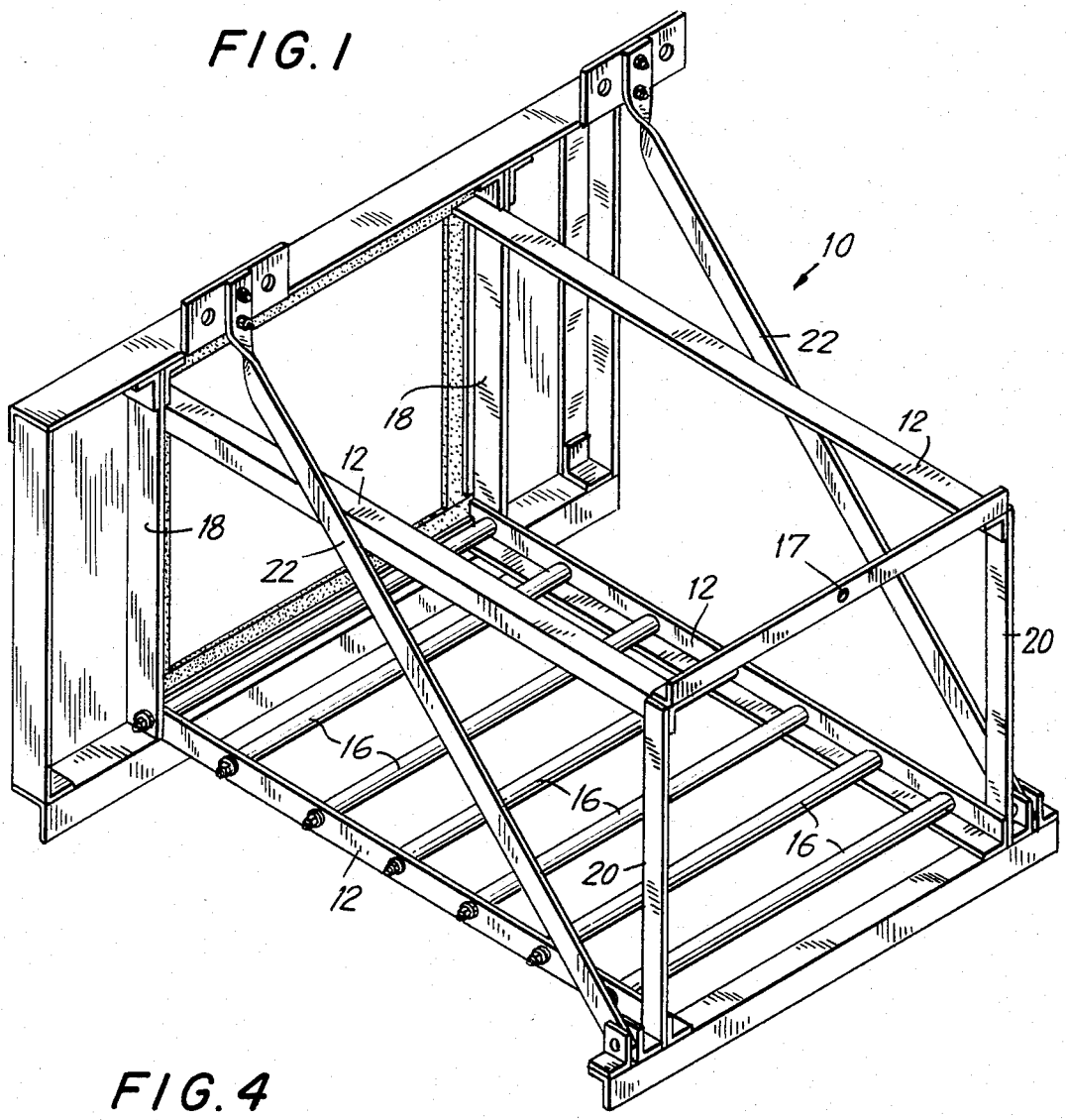
FIG. 1 is an elevated rear perspective view of a window-type air conditioner mounting assembly constructed in accordance with the teachings of the present invention.
Figure 4:
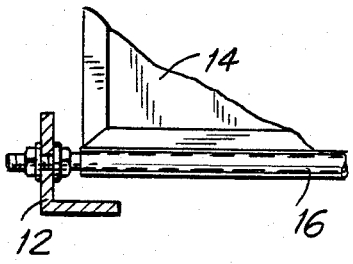
FIG. 4 is a detail of a lower rail and a freewheeling guide roller dependently extending therefrom.

Turning now to the drawing, there is illustrated in FIG. 1 a mounting assembly according to the present invention for receiving and supporting a window-mountable air conditioner in such manner that the unit may be guidedly moved between an operating position projecting through an open window and a non-operating storage postion interiorly remote from the window. As a consequence of this arrangement, the window is capable of being fully shut and thereby sealed against ambient air leakage during non-use of the air conditioner, thereby promoting energy efficiency and increasing the unit's useful life by minimizing its exposure to the elements. Although the preferred embodiment of the invention is described and illustrated in conjunction with a sash-type window, the present invention should be understood to be equally suitable for use with other window arrangements with only minimal modification deemed to be within the ability of an individual skilled in the relevent art.

The air conditioner mounting assembly, generally designated by the reference numeral 10, is seen in FIG. 1 to be in the form of an elongated, frame-like structure of generally rectangular cross section. The generally rectangular frame is defined by a series of four elongated rails, individually and collectively designated 12, located at the corners of the rectangle and forming the substantially horizontal path along which the air conditioner is selectively moveable. Each rail 12 may be formed of a metal bar substantially L-shaped in cross section both for ease of manufacture and to provide enhanced structural integrity of the frame. Thus, the upper-disposed pair of rails 12 may be thought of as comprising an upper track, while the lower-disposed pair of rails 12 correspondingly comprise a lower track, along which the air conditioner unit 14 is slideable from one end to the other of assembly 10. In order to facilitate air conditioner movement along rails 12, the lower-disposed set thereof is spanned by a plurality of freewheeling rollers 16 at spaced apart positions along the length of assembly 10. Rollers 16 will be further understood to contribute to the structural integrity and stability of mounting assembly 10.

By reason of their fixed placement between lower rails 12, rollers 16 assist in maintaining the spaced apart relation of lower rails 12 at a fixed distance determined by the particular air conditioner unit intended for use with mounting assembly 10. Additional fixed (nonrotatable) cross-members or bars may also be utilized between the lower rails 12—particularly at the extreme ends thereof—and it is intended that like cross-members 17 be provided in spanning relation between the pair of rails 12 forming the upper track. The precise location, relative spacing and number of such cross-members is a matter of design choice and will, of course, be at least partly dependent upon the weight and size of the air conditioner to be supported by the frame.

The corresponding fixed frame distance between the upper and lower tracks is maintained by pairs of forward and rear vertical members or struts 18 and 20, respectively. Forward vertical struts 18 span upper and lower rails 12 on laterally opposite sides of the unit proximate the rail ends located adjacent the window, while rear struts 20 similarly span the vertically spanned rails proximate their opposite ends remote from the window. As with rails 12, vertical struts 18 and 20 may be substantially L-shaped in cross section both for enhanced frame stability and to enable cooperative engagement of said struts with the air conditioner in a manner that will become clear as this description proceeds.

The basic frame assembly defined by elongated rails 12, rollers 16, cross-members 17 and forward and rear vertical struts 18, 20 is itself positioned for use in the manner shown in the drawing. The frame is mounted so that one end—here identified by the location of forward vertical struts 18—is maintained proximate the window, rails 12 extending substantially horizotally therefrom into the room or building interior. The particular manner in which the frame is so fixed and supported in position forms no part of the present invention and may be determined in accordance with the building structure and the like. Nevertheless, for purposes of illustration the disclosed embodiment is supported at its forward end on a horizontally mounted angle bracket bolted or otherwise secured to and between the opposed window frame vertical jambs. The interior or rear end of the frame, on the other hand, is supported on laterally opposite sides by a pair of braces 22 that extend upwardly from the rear ends of lower rails 12 to a portion of the wall located above the window.

In general, the width of assembly 10—i.e. the distance between lower rails 12—will be less than the width of the window with respect to which the air conditioner is to be supported. As a consequence of the permanent nature of the installation of the inventive mounting assembly 10 (only the air conditioner unit moves), an effective weather seal may and should be installed between the lateral frame sides and the vertical window jambs. An appropriate arrangement for this purpose may conveniently and attractively comprise a glass or otherwise transparent or translucent panel filling each such open area, with adequate weatherstripping or gasket material assuring an effective seal about the edges of each panel. In this manner the ability to use that part of the window not occupied by the air conditioner unit for viewing exterior or outside conditions is maintained. The area above the frame assembly 10 may be similarly partitioned off as necessitated by the dimensions of the air conditioner unit and the window.

As indicated, window 24, in conjunction with which the inventive mounting assembly 10 is illustrated, includes at least one moveable sash 26. Typically, such windows comprise a pair—upper and lower—of sashes, each being moveable so that either the top half or the bottom half of the window may be opened at the user's discretion. Although the inventive mounting assembly 10 may be utilized so as to operatively support the air conditioner at either the upper or lower portions of the window, the embodiment herein disclosed illustrates such mounting through the window's top portion. The accompanying description accordingly comtemplates that window sash 26 is lowered, from its fully closed or raised position, to operatively utilize the air conditioner, and that the sash is correspondingly raised to subsequently close and seal window 24.

A flap 28 spans lower rails 12 at their forward ends disposed adjacent window 24. Flap 28 is pivotally mounted between lower rails 12 and is freely moveable so that it hangs substantially straight down under the force of gravity when window sash 26 is in its normally closed or raised position. When sash 26 is lowered to open the window and enable operative use of the air conditioner, flap 28 is pivotable to the position shown in FIG. 1 wherein it rests atop sash 26 and thereby forms a barrier to the entry of ambient or outside air into the interior of the building or room being cooled.

More particularly, after fully lowering sash 26, flap 28 is manually pivoted upwardly from its normal or vertical position of nonuse and sash 26 is then raised or lifted a distance sufficient to bring the sash into contact with the flap. A jamb stop 30 may be provided on or adjacent the window frame so that, as sash 26 is lifted, it contacts flap 28 and forces the same into confined relation between jamb stop 30 and the top of sash 26; this arrangement maintains flap 28 stationary and provides an effective barrier against ambient air leakage below mounting assembly 10. Thus, the addition of jamb stop 30 assures that window sash 26 will be properly positioned in barrier-forming engagement with flap 28 during operative use of the mounted air conditioner.

When the air conditioner 14 is received in supporting relation within assembly 10, it is—as earlier indicated—slideably moveable along the length of the frame assembly. Such moveability is an essential part and feature of the invention in that it enables the air conditioner to be selectively positioned alternately in a storage condition remote from the window and in an operative position projecting through the window, with permanently installed elongated rails 12 defining the moving path. Thus, during winter or relatively cool months not requiring dehumidification and cooling of the interior room air, air conditioner 14 is maintained in its first, interior position within mounting assembly 10 and clear of window 24 so that sash 26 may be fully and normally closed in forward of the unit against ambient air leakage. At the onset of hot weather periods, on the other hand, the air conditioner unit 14 is slideable along the upper and lower track-defining rails 12 to a second position in which, with sash 26 lowered, it projects at least partially through window 24 in its normal operating disposition. Pivoting flap 28, in conjunction and contact with window sash 26, provides an effective barrier against ambient air leakage that might otherwise seriously impair the operating efficiency of the unit.

As the air conditioner is slideably moved between its first and second positions for, respectively, storage and use, it is essential that the ends of its travel path be defined. For this purpose, pairs of limit stops or tabs 32, 34 are appropriately mounted on opposite side faces of air conditioner 14. Limit stops 32, 34 are intended to cooperate with forward and rear vertical struts 18, 20—which act in the nature of path delimiting stops—to prevent the air conditioner from inadvertent movement beyond its first and second positions along mounting assembly 10. Thus, forward limit stops 32—one on each side face of air conditioner unit 14—cooperate with forward struts 18 to preclude forward travel of the unit beyond its intended operative projecting position through window 24. Likewise, rear limit stops 34 cooperate with rear struts 20 to define the storage position of the air conditioner remote from the window along mounting assembly 10. Those skilled in the art will readily understand that the precise placement of limit stops 32, 34 on the air conditioner will depend upon a number of factors including the particular unit supported by the inventive assembly, its desired or required projection through the window during use, and the length or elongation of the supporting frame. It is of course expected and intended that the operating position of the air conditioner—and its projection through window 24—be such as to insure that the condenser vents or openings of the unit be located exterior of the window and, with respect to the mounting of forward limit stops 32 on air conditioner 14, this requirement should provide the major determining factor in their proper placement.

In any event, where forward and rear vertical struts 18, 20 are L-shaped in cross section, limit stops 32, 34 may conveniently comprise correspondingly L-shaped brackets or tabs that project outwardly from the air conditioner side walls a distance sufficient to cooperatively contact struts 18, 20 proximate the ends of the air conditioner movement path. Other arrangements may alternatively be utilized and should be considered within the scope and contemplation of the present invention.

There has accordingly been disclosed a mounting frame and assembly for a window-type air conditioner that successfully overcomes problems of prior art mounting structures and which includes noteworthy features not heretofore available. The inventive mounting assembly is intended for permanent installation and, by reason of the moveability of the supported air conditioner between its operating and storage positions, previously practiced procedures for mounting and dismounting a unit, including seasonally attempting to recreate an effective ambient air seal thereabout, are eliminated. As a consequence, the air conditioner need never be removed from the inventive mount and, even if such removal for repair should prove necessary, the same may be accomplished merely by detaching limit stops 32, 34 to enable the air conditioner to slide fully out and free of the inventive frame at its end remote from the window.

The fact that the window may be fully and normally closed in forward of the air conditioner during periods of non-use elimintes the often unattainable task of attempting to create an effective ambient air seal about the air conditioner, or having to recreate the seal when the unit is reinstalled for subsequent use. Moreover, the life of the air conditioner will be prolonged since, during extended periods of non-use, the unit is moveable (while still supported in the mounting assembly) into the room or building interior and therefore out of contact with the exterior weather elements capable of causing substantial damage during the winter months.

While there have been shown and described and pointed out fundamental novel features of the invention as applied to a preferred embodiment thereof, it will be understood that various omissions ad substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An apparatus for mounting an air conditioner for operative disposition with respect to a moveable sash window of a room, said apparatus comprising:

elongated rail means for supporting the air conditioner and along which the air conditioner is moveable between a first, nonoperative position within the room and remote from the window to enable the window sash to be fully closed and thereby sealed against substantial ambient air leakage thereabout, and a second, operative position in which the air conditioner is disposed in projecting relation through the open window sash, said rail means comprising a plurality of elongated rails unitarily joined to define a fixed, cross-sectionally rectangular frame along and within which the air conditioner is moveable between said first and second positions;

moveable flap means on said rail means adjacent the window for contact with the sash in its open condition to define a barrier against ambient air leakage between the operatively disposed air conditioner and the open window sash;

roller means on said rail means for facilitating movement of the air conditioner between said first and second positions thereof;

stop means mounted at opposite ends along the elongation of said rail means; and tab means predeterminately mountable on the air conditioner for cooperative engagement with said stop means to limit the maximum movement of the air conditioner along said rail means and thereby define siad first and second positions of the air conditioner.

2. An apparatus in accordance with claim 1, further including jamb means fixedly mounted adjacent the window, and said flap means being pivotally moveable from a free position of non-use when the window sash is fully closed to an ambient air barrier defining position in which said flap means is maintained stationary between the window sash and said jamb means to provide said barrier, said jamb means being mounted to prevent further pivotal movement of said flap means beyond said barrier defining position so that said flap means is stationarily and abuttingly confined between said jamb means and the window sash.

3. An apparatus in accordance with claim 1, said rails comprising horizontally disposed pairs of upper and lower tracks along which the air conditioner is moveably slideable between said first and second positions thereof, and said stop means comprising substantially vertically disposed struts extending between said upper and lower tracks at opposite ends along the elongation thereof.

4. An apparatus in accordance with claim 3, said roller means comprising a plurality of freewheeling rollers extending between said rails of the lower track at spaced apart positions along the elongation of said rails.

* * * * *